US010431153B2

(12) United States Patent
Gao et al.

(10) Patent No.: US 10,431,153 B2
(45) Date of Patent: Oct. 1, 2019

(54) PIXEL CIRCUIT, METHOD FOR DRIVING THE SAME, AND ORGANIC ELECTROLUMINESCENT DISPLAY PANEL

(71) Applicant: Shanghai Tianma AM-OLED Co., Ltd., Shanghai (CN)

(72) Inventors: Yana Gao, Shanghai (CN); Renyuan Zhu, Shanghai (CN); Yue Li, Shanghai (CN); Dongxu Xiang, Shanghai (CN); Zeyuan Chen, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/865,097

(22) Filed: Jan. 8, 2018

(65) Prior Publication Data

US 2018/0130410 A1 May 10, 2018

(30) Foreign Application Priority Data

Jul. 12, 2017 (CN) ..... 2017 1 0567315

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0426* (2013.01);
(Continued)

(58) Field of Classification Search
CPC ... G09G 2300/0819; G09G 2300/0842; G09G 2310/0262; G09G 2310/0272;
(Continued)

(56) References Cited

U.S. PATENT DOCUMENTS 8,358,299 B2 * 1/2013 Chaji ..... G09G 3/3233 345/211
8,575,602 B2 * 11/2013 Noguchi ..... H01L 27/3276 257/40

(Continued)

FOREIGN PATENT DOCUMENTS

CN 105528992 A 4/2016
CN 105679249 A 6/2016

(Continued)

*Primary Examiner* — Michael J Jansen, II
(74) *Attorney, Agent, or Firm* — Alston & Bird LLP

(57) ABSTRACT

The disclosure discloses a pixel circuit, a method for driving the same, and an organic electroluminescent display panel, where the pixel circuit includes a node initialization module and a drive control module, the node initialization module includes a first switch transistor with a gate electrically connected with a first scan signal terminal, a source electrically connected with a first reference signal terminal, and a drain electrically connected with a first node; and a seventh switch transistor with a gate electrically connected with the first scan signal terminal, a source electrically connected with the second reference signal terminal, and a drain electrically connected with the second node; the drive control module includes a drive transistor with a gate electrically connected with the first node, a source electrically connected with the second node.

16 Claims, 7 Drawing Sheets

(52) U.S. Cl.
CPC ..... *G09G 2300/0819* (2013.01); *G09G 2300/0842* (2013.01); *G09G 2300/0861* (2013.01); *G09G 2300/0866* (2013.01); *G09G 2310/08* (2013.01); *G09G 2320/0214* (2013.01); *G09G 2320/0219* (2013.01); *G09G 2320/0233* (2013.01); *G09G 2320/0257* (2013.01); *G09G 2320/045* (2013.01)

(58) Field of Classification Search
CPC ..... G09G 2310/0289; G09G 2310/08; G09G 2320/0214; G09G 2320/0233; G09G 2320/0238; G09G 3/3233; G09G 3/3266; G09G 3/3275; G09G 2300/0426; G09G 2300/0861; G09G 2300/0866; G09G 2320/0219; G09G 2320/0257; G09G 2320/045; G09G 3/3225; H01L 27/3276
See application file for complete search history.

(56) References Cited

U.S. PATENT DOCUMENTS 8,743,032 B2 * 6/2014 Yamashita ..... G09G 3/3233 345/76
8,786,526 B2 * 7/2014 Noguchi ..... G09G 3/3233 345/77
8,947,414 B2 * 2/2015 Noguchi ..... G09G 3/3233 345/211
9,167,635 B2 * 10/2015 Yamashita ..... B41J 2/385
9,236,484 B2 * 1/2016 Kim ..... H01L 29/78615
9,286,832 B2 * 3/2016 Park ..... G09G 3/3291
9,396,681 B2 * 7/2016 In ..... G09G 3/3266
9,460,658 B2 * 10/2016 Kim ..... G09G 3/3233
9,780,331 B2 * 10/2017 Lee ..... H01L 51/5253
9,792,853 B2 * 10/2017 Jeon ..... G09G 3/3233
9,947,269 B2 * 4/2018 Jung ..... G09G 3/2085
9,972,242 B2 * 5/2018 Lim ..... G09G 3/3233
10,004,124 B1 * 6/2018 Ko ..... G09G 3/3233
10,103,342 B2 * 10/2018 Lee ..... H01L 27/10882
10,170,038 B2 * 1/2019 Jeon ..... G09G 3/3233
10,192,938 B2 * 1/2019 Yu ..... H01L 27/3223
10,236,334 B2 * 3/2019 Lee ..... H01L 51/5212
10,242,620 B2 * 3/2019 Zhu ..... H01L 27/12
10,249,236 B2 * 4/2019 Choi ..... G09G 3/3233
10,255,849 B2 * 4/2019 Ma ..... G09G 3/3225
2009/0109208 A1 * 4/2009 Yamashita ..... G09G 3/3233 345/214
2010/0207920 A1 * 8/2010 Chaji ..... G09G 3/3233 345/211
2012/0120045 A1 * 5/2012 Noguchi ..... G09G 3/3233 345/211
2012/0127220 A1 * 5/2012 Noguchi ..... G09G 3/3233 345/690
2012/0199854 A1 * 8/2012 Noguchi ..... H01L 27/3276 257/88
2013/0002616 A1 * 1/2013 Kim ..... H01L 29/78615 345/204
2014/0078233 A1 * 3/2014 Yamashita ..... B41J 2/385 347/118
2014/0210867 A1 * 7/2014 Kwon ..... G09G 3/3258 345/690
2014/0333686 A1 * 11/2014 Kim ..... G09G 3/3233 345/694
2015/0009108 A1 * 1/2015 Song ..... G09G 3/3225 345/80
2015/0009199 A1 * 1/2015 In ..... G09G 3/3266 345/212
2015/0294618 A1 * 10/2015 Park ..... G09G 3/3233 345/214
2016/0232849 A1 * 8/2016 Jeon ..... G09G 3/3233
2016/0253958 A1 * 9/2016 Ma ..... G09G 3/3225 345/211
2016/0322445 A1 * 11/2016 Lee ..... H01L 51/5253
2016/0351122 A1 * 12/2016 Jung ..... G09G 3/2085
2016/0372037 A1 * 12/2016 Lim ..... G09G 3/3233
2017/0032739 A1 * 2/2017 Kim ..... G09G 3/3233
2017/0076646 A1 3/2017 Gu et al.
2017/0110049 A1 * 4/2017 Choi ..... G09G 3/2092
2017/0140706 A1 * 5/2017 Song ..... G09G 3/3233
2017/0331061 A1 * 11/2017 Lee ..... H01L 27/10882
2017/0365213 A1 * 12/2017 Rieutort-Louis .... G09G 3/3233
2017/0365214 A1 * 12/2017 Tsai ..... G09G 3/3233
2018/0061324 A1 * 3/2018 Kim ..... G09G 3/3275
2018/0069191 A1 * 3/2018 Lee ..... H01L 51/5212
2018/0144684 A1 * 5/2018 Jeon ..... G09G 3/3233
2018/0166025 A1 * 6/2018 Zhou ..... G09G 3/3233
2018/0190194 A1 * 7/2018 Zhu ..... H01L 27/12
2018/0204889 A1 * 7/2018 Yu ..... G09G 3/3233
2018/0226028 A1 * 8/2018 Park ..... G09G 3/3258
2018/0226459 A1 * 8/2018 Bae ..... H01L 27/3246
2018/0301088 A1 * 10/2018 Kim ..... G09G 3/3241
2018/0308427 A1 * 10/2018 Zhang ..... G09G 3/3208

FOREIGN PATENT DOCUMENTS

CN 104036724 B 11/2016
CN 106558287 A 4/2017
CN 106710529 A 5/2017

* cited by examiner

--Prior Art--

--Prior Art--

PIXEL CIRCUIT, METHOD FOR DRIVING THE SAME, AND ORGANIC ELECTROLUMINESCENT DISPLAY PANEL

CROSS-REFERENCE TO RELATED APPLICATION

This application claims priority to Chinese Patent Application No. 201710567315.8, filed on Jul. 12, 2017, the content of which is incorporated by reference in the entirety.

FIELD OF INVENTION

The present disclosure relates to the field of display technologies, and particularly to a pixel circuit, a method for driving the same, and an organic electroluminescent display panel.

BACKGROUND

An Organic Light Emitting Diode (OLED) display is a focus in the research field of flat panel displays. The OLED display has lower power consumption, a lower production cost, is self-illuminating, has a wider angle of view, has a higher response speed, and has several other advantages as compared with a Liquid Crystal Display (LCD). At present, the OLED display has taken the place of the traditional LCD in the field of flat panel displays including a mobile phone, a Personal Digital Assistant (PDA), a digital camera, etc., where the design of a pixel circuit is a core technology of the OLED display, and of great significance to the research thereof.

BRIEF SUMMARY

Embodiments of the disclosure provide a pixel circuit, a method for driving the same, and an organic electroluminescent display panel.

In one aspect, an embodiment of the disclosure provides a pixel circuit including a node initialization module, a data writing module, an anode reset module, a light emitting control module, a drive control module, and an organic light emitting diode, wherein: the node initialization module includes a first switch transistor with a gate electrically connected with a first scan signal terminal, a source electrically connected with a first reference signal terminal, and a drain electrically connected with a first node; the data writing module includes a second switch transistor and a third switch transistor, wherein the second switch transistor has a gate electrically connected with a second scan signal terminal, a source electrically connected with a data signal terminal, and a drain electrically connected with a second node; and the third switch transistor has a gate electrically connected with the second scan signal terminal, a source electrically connected with a third node, and a drain electrically connected with the first node; the anode reset module includes a fourth switch transistor with a gate electrically connected with the second scan signal terminal, a source electrically connected with the first reference signal terminal, and a drain electrically connected with a fourth node; the light emitting control module includes a fifth switch transistor and a sixth switch transistor, wherein the fifth switch transistor has a gate electrically connected with a light emitting control terminal, a source electrically connected with a first voltage signal terminal, and a drain electrically connected with the second node; and the sixth switch transistor has a gate electrically connected with the light emitting control terminal, a source electrically connected with the third node, and a drain electrically connected with the fourth node; the drive control module includes a drive transistor and a capacitor, wherein the drive transistor has a gate electrically connected with the first node, a source electrically connected with the second node, and a drain electrically connected with the third node; and the capacitor is connected between the first node and the first voltage signal terminal; the organic light emitting diode is connected between the fourth node and a second voltage signal terminal; and the node initialization module further includes a seventh switch transistor, and the seventh switch transistor has a gate electrically connected with the first scan signal terminal, a source electrically connected with the second reference signal terminal, and a drain electrically connected with the second node.

In another aspect, an embodiment of the disclosure further provides a method for driving the pixel circuit above, the method including: an initialization stage to provide the first scan signal terminal with a first level signal, the second scan signal terminal with a second level signal, and the light emitting control terminal with the second level signal; a data writing stage to provide the first scan signal terminal with the second level signal, the second scan signal terminal with the first level signal, and the light emitting control terminal with the second level signal; and a light emitting stage to provide the first scan signal terminal with the second level signal, the second scan signal terminal with the second level signal, and the light emitting control terminal with the first level signal.

In still another aspect, an embodiment of the disclosure further provides an organic electroluminescent display panel including a plurality of arrayed pixel circuits, each pixel circuit including a node initialization module, a data writing module, an anode reset module, a light emitting control module, a drive control module, and an organic light emitting diode, wherein: the node initialization module includes a first switch transistor with a gate electrically connected with a first scan signal terminal, a source electrically connected with a first reference signal terminal, and a drain electrically connected with a first node; the data writing module includes a second switch transistor and a third switch transistor, wherein the second switch transistor has a gate electrically connected with a second scan signal terminal, a source electrically connected with a data signal terminal, and a drain electrically connected with a second node; and the third switch transistor has a gate electrically connected with the second scan signal terminal, a source electrically connected with a third node, and a drain electrically connected with the first node; the anode reset module includes a fourth switch transistor with a gate electrically connected with the second scan signal terminal, a source electrically connected with the first reference signal terminal, and a drain electrically connected with a fourth node; the light emitting control module includes a fifth switch transistor and a sixth switch transistor, wherein the fifth switch transistor has a gate electrically connected with a light emitting control terminal, a source electrically connected with a first voltage signal terminal, and a drain electrically connected with the second node; and the sixth switch transistor has a gate electrically connected with the light emitting control terminal, a source electrically connected with the third node, and a drain electrically connected with the fourth node; the drive control module includes a drive transistor and a capacitor, wherein the drive transistor has a gate electrically connected with the first node, a source electrically connected with the second node, and a drain electrically connected with the third node; and the capacitor is connected between the first node and the first voltage signal terminal; the organic light emitting diode is connected between the fourth node and a second voltage signal terminal; and the node initialization module further includes a seventh switch transistor, and the seventh switch transistor has a gate electrically connected with the first scan signal terminal, a source electrically connected with the second reference signal terminal, and a drain electrically connected with the second node.

DETAILED DESCRIPTION OF THE EMBODIMENTS

Figure 1:
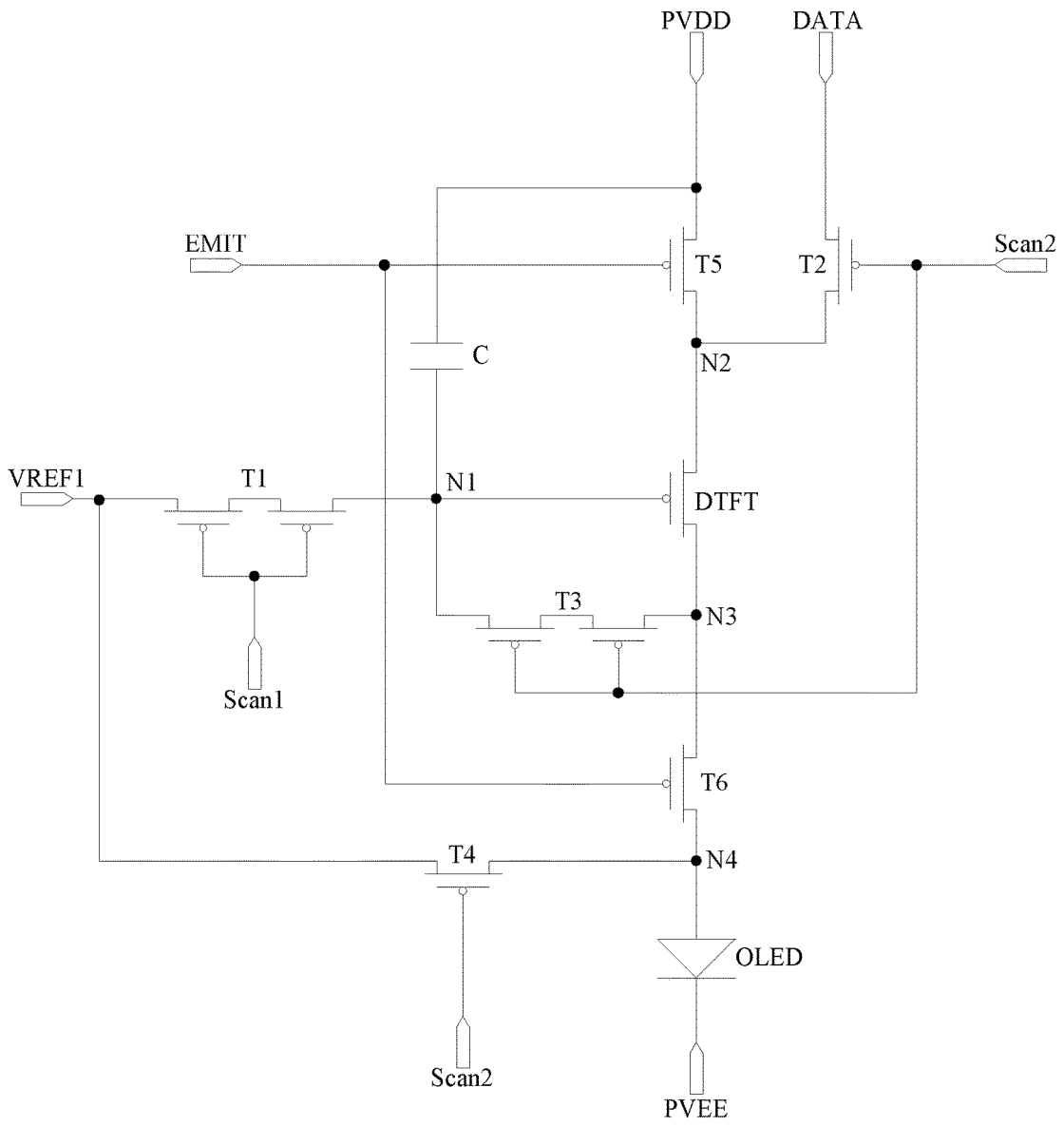
FIG. 1 is a schematic circuit diagram of a pixel circuit in the related art.
Figure 2:
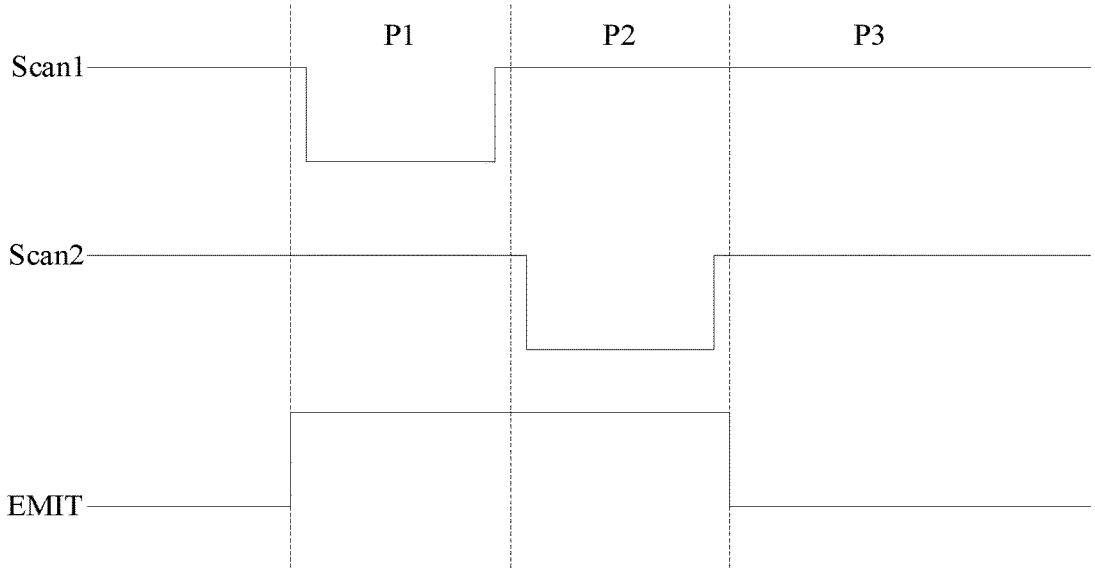
FIG. 2 is a time sequence diagram corresponding to the pixel circuit in FIG. 1.

The structure of a pixel circuit in the related art is as illustrated in FIG. 1, where the pixel circuit includes six switch transistors T1 to T6, a drive transistor DTFT, and a capacitor C. A corresponding input time sequence diagram thereof is as illustrated in FIG. 2. Although compensation is made in the circuit to thereby alleviate the problem of display non-uniformity arising from drifting of the threshold voltage of the drive transistor due to a process of the circuit, and aging of the transistor, the brightness of a first frame may differ after the image is switched between high and low grayscales. Furthermore after the pixel circuit has emitted light for a period of time, the threshold voltage of the drive transistor may be offset due to a bias stress, and an after-image may occur due to the varying offset.

With simulation of the pixel circuit in FIG. 1, when the (n−1)-th frame is at the grayscale 0, the n-th frame is at the grayscale 255, and the (n+1)-th frame is at the grayscale 255, potentials of a first node N1 and a second node N2 in different periods of time are detected as depicted in Table 1 below.

TABLE 1

| Grayscale | 0 | 255 | | | 255 | |
|---|---|---|---|---|---|---|
| Frame No. | (n − 1)-th frame | n-th frame | | | (n + 1)-th frame | |
| Stage | Light emitting stage | Initialization stage | Data writing stage | Light emitting stage | Initialization stage | Data writing stage |
| N1 | 3.44 | −3 | 1.03 | 1.5 | −3 | 1.02 |
| N2 | 4.6 | −0.65 | 3.5 | 4.6 | 0.15 | 3.5 |

As can be seen from Table 1 above, the potential of the second node N2 in the n-th frame is different from the potential of the second node N2 in the (n+1)-th frame in the initialization stage. This is because the first node N1 is switched to the potential −3V in the n-th frame from 3.44V, and the first node N1 is switched to the potential −3V in the (n+1)-th frame from 1.5V, in the initialization stage. And there is a parasitic capacitance between the first node N1 and the second node N2 in the pixel circuit, and the second node N2 is floating in the initialization stage. Therefore, there is such a different change in voltage ΔV of the first node N1 that the potential of the second node N2 in the n-th frame is different from the potential of the second node N2 in the (n+1)-th frame in the initialization stage, so that the potential of the first node N1 in the n-th frame is different from the potential of the first node N1 in the (n+1)-th frame in the data writing stage, thus resulting in such a problem that the brightness of the n-th frame is different from the brightness of the (n+1)-th frame.

Embodiments of the disclosure provide a pixel circuit, a method for driving the same, and an organic electroluminescent display panel to thereby reset the potentials of the first node N1 and the second node N2 simultaneously in the initialization stage so as to address the problem of different brightness arising from their difference in potential due to the parasitic capacitance between them.

In order to make the objects, technical solutions, and advantages of the embodiments of the disclosure more apparent, particular implementations of the pixel circuit, the method for driving the same, and the organic electroluminescent display panel according to the embodiments of the disclosure will be described below in details with reference to the drawings. It shall be noted that the preferred embodiments to be described below are merely intended to illustrate and explain the disclosure, but not to limit the disclosure thereto; and the embodiments of the disclosure and the features in the embodiments can be combined with each other unless they conflict with each other.

Figure 3:
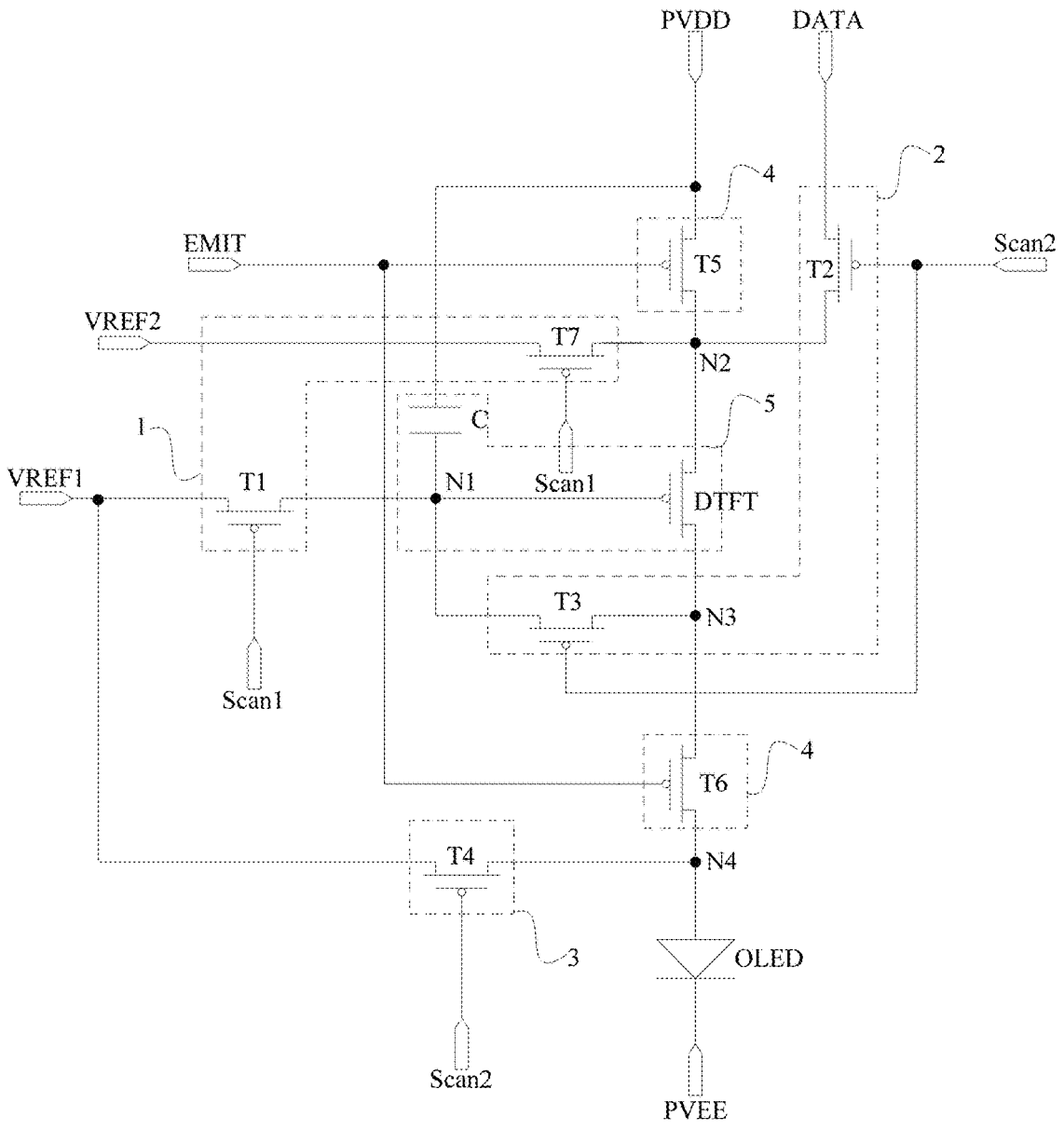
FIG. 3 is a first schematic circuit diagram of a pixel circuit according to an embodiment of the disclosure.

An embodiment of the disclosure provides a pixel circuit as illustrated in FIG. 3 including a node initialization module 1, a data writing module 2, an anode reset module 3, a light emitting control module 4, a drive control module 5, and an organic light emitting diode OLED.

The node initialization module 1 includes a first switch transistor T1 with a gate electrically connected with a first scan signal terminal Scan1, a source electrically connected with a first reference signal terminal VREF1, and a drain electrically connected with a first node N1.

The data writing module 2 includes a second switch transistor T2 and a third switch transistor T3, where the second switch transistor T2 has a gate electrically connected with a second scan signal terminal Scan2, a source electrically connected with a data signal terminal DATA, and a drain electrically connected with a second node N2. The third switch transistor T3 has a gate electrically connected with the second scan signal terminal Scan2, a source electrically connected with a third node N3, and a drain electrically connected with the first node N1.

The anode reset module 3 includes a fourth switch transistor T4 with a gate electrically connected with the second scan signal terminal Scan2, a source electrically connected with the first reference signal terminal VREF1, and a drain electrically connected with a fourth node N4.

The light emitting control module 4 includes a fifth switch transistor T5 and a sixth switch transistor T6, where the fifth switch transistor T5 has a gate electrically connected with a light emitting control terminal EMIT, a source electrically connected with a first voltage signal terminal PVDD, and a drain electrically connected with the second node N. The sixth switch transistor T6 has a gate electrically connected with the light emitting control terminal EMIT, a source electrically connected with the third node N3, and a drain electrically connected with the fourth node N4.

The drive control module 5 includes a drive transistor DTFT and a capacitor C, where the drive transistor DTFT has a gate electrically connected with the first node N1, a source electrically connected with the second node N2, and a drain electrically connected with the third node N3. The capacitor C is connected between the first node N1 and the first voltage signal terminal PVDD.

The organic light emitting diode OLED is connected between the fourth node N4 and a second voltage signal terminal PVEE.

The node initialization module 1 further includes a seventh switch transistor T7, and the seventh switch transistor T7 has a gate electrically connected with the first scan signal terminal Scan1, a source electrically connected with the second reference signal terminal VREF2, and a drain electrically connected with the second node N2.

In the pixel circuit above according to the embodiment of the disclosure, both the first node N1 and the second node N2 can be reset in the initialization stage through the first switch transistor T1 and the seventh switch transistor T7 in the node initialization module 1 to thereby avoid their difference in potential due to the parasitic capacitance between them. The drive transistor DTFT has the gate electrically connected with the first node N1, and the source electrically connected with the second node N2; and since the drive transistor DTFT is reset in the initialization stage to thereby avoid the problem of a differently grabbed threshold due to a voltage jump, the same brightness of the first frame can be guaranteed after the image is switched between high and low grayscales. Furthermore the drive transistor DTFT is completely reset in the initialization stage of each frame so that an afterimage can also be avoided from occurring as a result of an offset of the threshold voltage of the drive transistor DTFT.

With simulation of the pixel circuit in FIG. 3, when the (n−1)-th frame is at the grayscale 0, the n-th frame is at the grayscale 255, and the (n+1)-th frame is at the grayscale 255, potentials of a first node N1 and a second node N2 in different periods of time are detected as depicted in Table 2 below.

TABLE 2

| Grayscale | 0 | 255 | | | 255 | |
|---|---|---|---|---|---|---|
| Frame No. | (n − 1)-th frame | n-th frame | | | (n + 1)-th frame | |
| Stage | Light emitting stage | Initialization stage | Data writing stage | Light emitting stage | Initialization stage | Data writing stage |
| N1 | 3.44 | −3 | 1.03 | 1.5 | −3 | 1.03 |
| N2 | 4.6 | −3 | 3.5 | 4.6 | −3 | 3.5 |

As can be seen from Table 2 above, the potential of the second node N2 in the n-th frame is the same as the potential of the second node N2 in the (n+1)-th frame in the initialization stage. Particularly the first node N1 is switched to the potential −3V in the n-th frame from 3.44V, and the first node N1 is switched to the potential −3V in the (n+1)-th frame from 1.5V, in the initialization stage. And although there is a parasitic capacitance between the first node N1 and the second node N2 in the pixel circuit, the second node N2 is reset by the second reference signal terminal VREF2 to the potential −3V in the initialization stage. Therefore, the different change in voltage ΔV of the first node N1 will not affect the potential of the second node N2 in the n-th frame, and the potential of the second node N2 in the (n+1)-th frame in the initialization stage, and furthermore will not affect the potential of the first node N1 in the n-th frame, and the potential of the first node N1 in the (n+1)-th frame in the data writing stage, so that the brightness of the n-th frame is the same as the brightness of the (n+1)-th frame.

In a particular implementation, in the pixel circuit above according to the embodiment of the disclosure, the potential of the second node N2 in the initialization stage is affected by the potential signal of the second reference signal terminal VREF2, and as illustrated in FIG. 3, the second reference signal terminal VREF2 may be a separate signal terminal, that is, there is a different signal thereof from those of the other signal terminals. At this time, a desirable potential signal may be input to the second reference signal terminal VREF2 as needed, for example, a higher potential signal than that of the first reference signal terminal VREF1 may be input thereto so that Vgs of the drive transistor is negatively biased and this alleviates the problem of drifting of the threshold voltage of the drive transistor, operating in the black state, with positive Vgs. For example, the potential signal of the second reference signal terminal VREF2 may alternatively be the same as that of the first reference signal terminal VREF1, or may be the same as that of the first voltage signal terminal PVDD, although the embodiment of the disclosure will not be limited thereto.

In one or more embodiments, in the pixel circuit above according to the embodiment of the disclosure, in order to reduce the number of signal terminals, and to save a wiring space, the second reference signal terminal VREF2, and the first reference signal terminal VREF1 may be connected with the same signal terminal. At this time, the potentials of the first node N1 and the second node N2 are reset to be the same potential through the first switch transistor T1 and the seventh switch transistor T7, both of which are separate, in the initialization stage. The potential of the second node N2 can be controlled through the seventh switch transistor T7 separate from the first switch transistor T1 to thereby alleviate in effect an interference of a coupling effect and leakage current.

In one or more embodiments, in the pixel circuit above according to the embodiment of the disclosure, in order to reduce the number of signal terminals, and to save wiring space, the second reference signal terminal VREF2, and the first voltage signal terminal PVDD may be further connected with the same signal terminal. At this time, the potentials of the first node N1 and the second node N2 are reset through the first switch transistor T1 and the seventh switch transistor T7, both of which are separate, in the initialization stage so that the potential of the first node N1 is the first reference signal, and the potential of the second node N2 is the first voltage signal, and thus Vgs of the drive transistor is negatively biased and this alleviates the problem of drifting of the threshold voltage of the drive transistor, operating in the black state, with positive Vgs. This is because positively biased voltage, i.e., positive voltage, needs to be applied to the gate of the drive transistor to thereby enable the drive transistor, which is a P-type transistor, to be turned off to display in the black state, and at this time, the threshold voltage of the drive transistor may be offset, so the threshold voltage can be alleviated from being offset by negatively biasing the drive transistor Vgs. Furthermore the potential of the second node N2 can be controlled through the seventh switch transistor T7 separate from the first switch transistor T1 to thereby alleviate in effect an interference of a coupling effect and leakage current.

Figure 4:
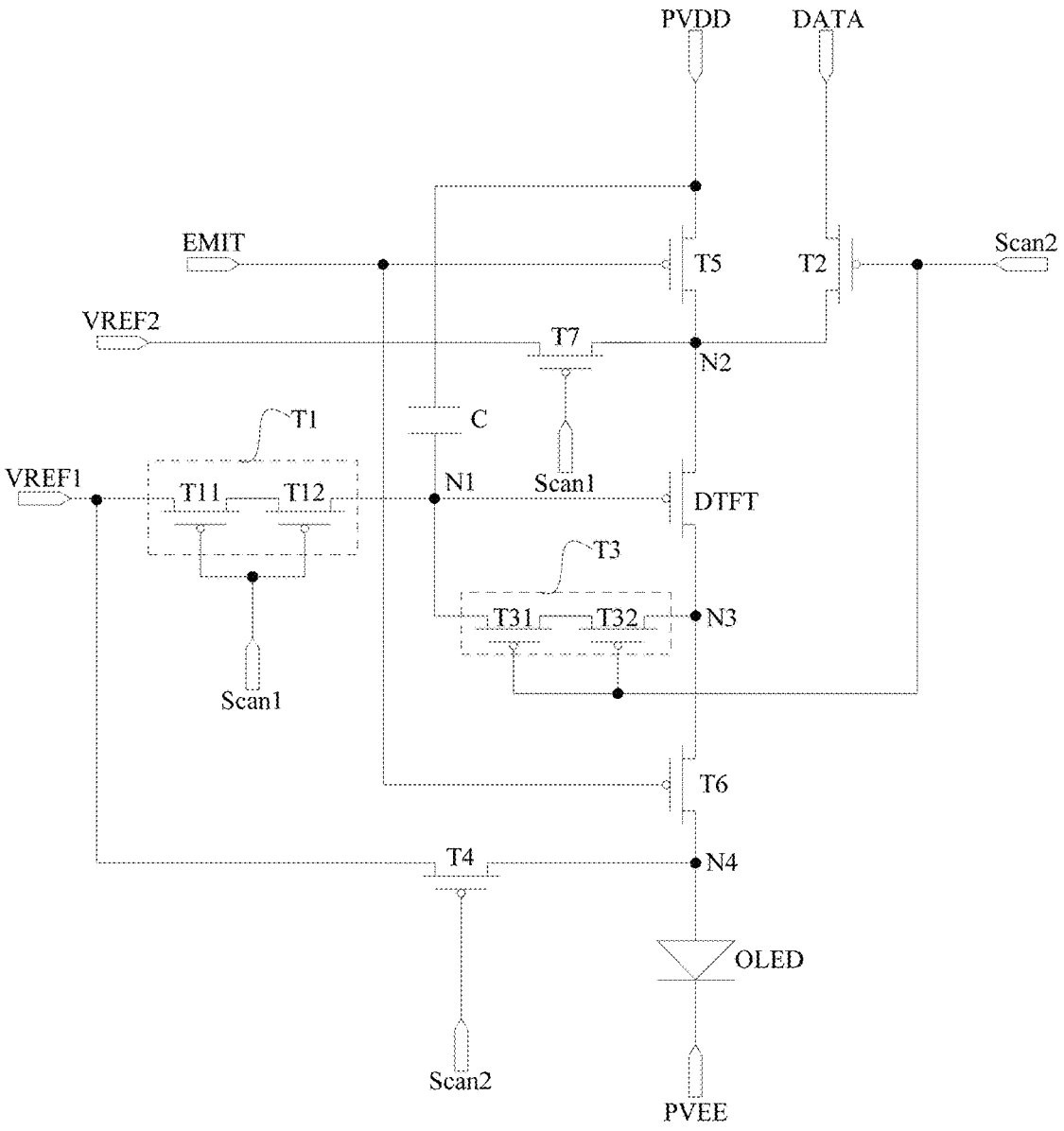
FIG. 4 is a second schematic circuit diagram of a pixel circuit according to an embodiment of the disclosure.

In a particular implementation, in the pixel circuit above according to the embodiment of the disclosure, as illustrated in FIG. 4, the first switch transistor T1 may has a dual gate structure to thereby lower leakage current of the first switch transistor T1 when the first switch transistor T1 is turned off, so as to lower interference of the leakage current of the first switch transistor T1 in the light emitting stage to the drive transistor DTFT, which would otherwise affect driving current of the drive transistor DTFT. Particularly as illustrated in FIG. 4, the first switch transistor T1 includes a first sub-switch transistor T11 and a second sub-switch transistor T12.

The first sub-switch transistor T11 has a drain electrically connected with a source of the second sub-switch transistor T12.

The first sub-switch transistor T11 has a gate, and the second sub-switch transistor T12 has a gate, both of which are electrically connected with the first scan signal terminal Scan1.

The first sub-switch transistor T11 has a source electrically connected with the first reference signal terminal VREF1, and the second sub-switch transistor T12 has a drain electrically connected with the first node N1.

Figure 5:
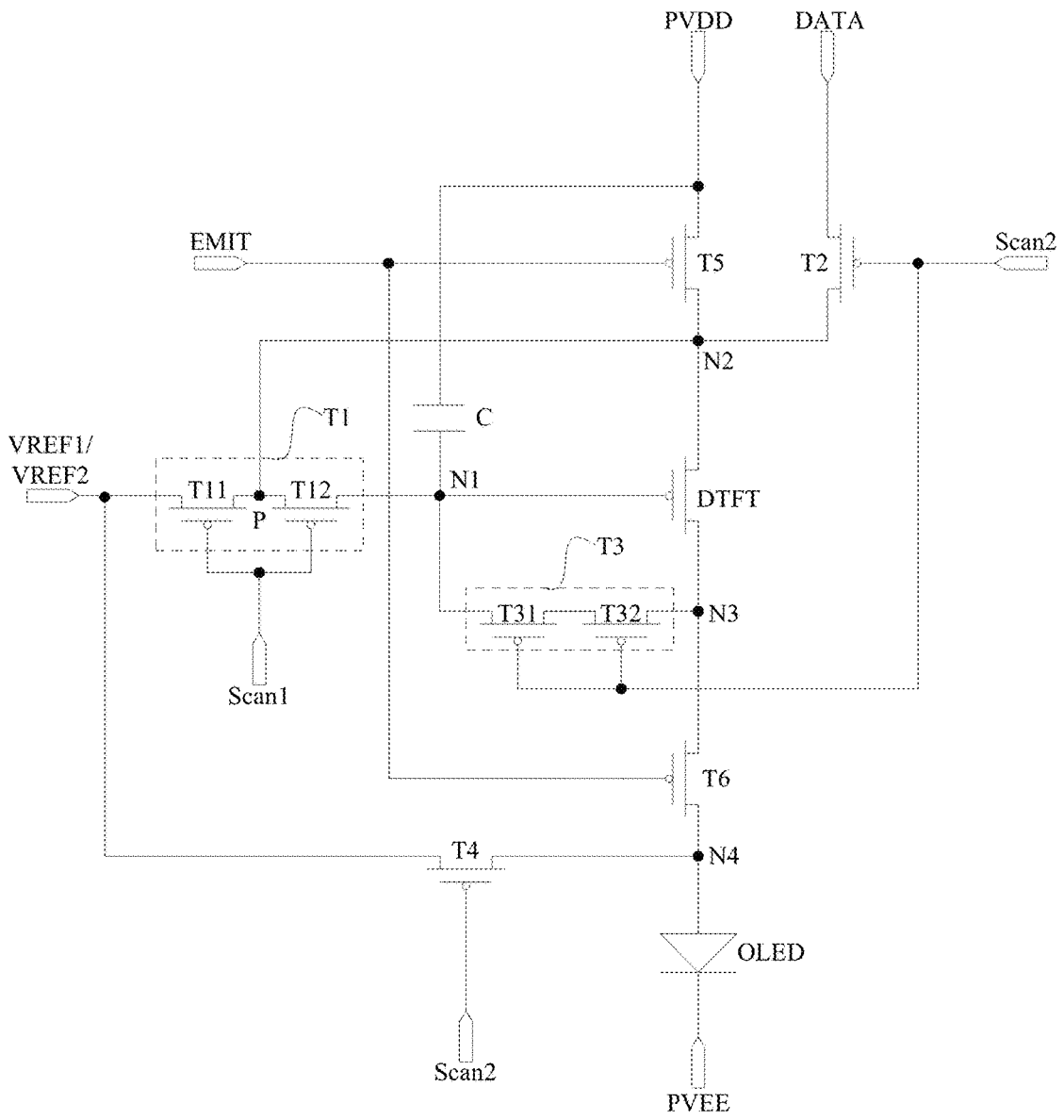
FIG. 5 is a third schematic circuit diagram of a pixel circuit according to an embodiment of the disclosure.

The first switch transistor T1 may be structured with dual gates, in a particular implementation, in the pixel circuit above according to the embodiment of the disclosure, in order to reduce the number of transistors, and to simplify the circuit structure, as illustrated in FIG. 5, the seventh switch transistor T7 can be the same switch transistor as the first sub-switch transistor T11. The second reference signal terminal VREF2 is the same signal terminal as the first reference signal terminal VREF1; and a connection node P between the drain of the first sub-switch transistor T11, and the source of the second sub-switch transistor T12 is electrically connected with the second node N2, so that when the first sub-switch transistor T11 and the second sub-switch transistor T12 are turned on, the first reference signal of the first reference signal terminal VREF1 resets both the first node N1 and the second node N2 to the same potential.

Figure 6:
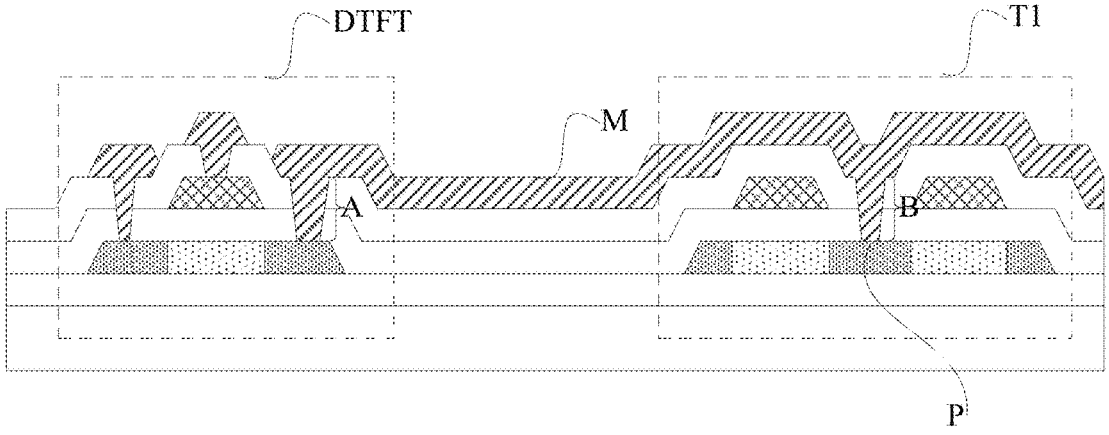
FIG. 6 is a schematic structural diagram of a part of the circuit in FIG. 5.

In a particular implementation, in the pixel circuit above according to the embodiment of the disclosure, further to the structure as illustrated in FIG. 5 where the seventh switch transistor T7 is the same switch transistor as the first sub-switch transistor T11, in order to enable the connection node P to be electrically connected with the second node N2, as illustrated in FIG. 6, the pixel circuit further includes a connection line M arranged between the second node N2 and the connection point P. The connection line M has one terminal electrically connected with the source of the drive transistor DTFT through a via hole A, and the other terminal electrically connected with the connection node P through a via hole B. Particularly FIG. 6 illustrates a schematic structural diagram of the drive transistor DTFT and the first switch transistor T1 which are top gate type transistors by way of an example, where the connection line M can be fabricated at the same film layer as an electrode joining the drive transistor DTFT and the first switch transistor T1, so that no new film layer will be added to the original circuit film layer structure without any additional fabrication process.

In a particular implementation, in the pixel circuit above according to the embodiment of the disclosure, as illustrated in FIG. 4 and FIG. 5, the third switch transistor T3 can have a dual gate structure to thereby lower leakage current of the third switch transistor T3 when the third switch transistor T3 is turned off, so as to lower interference of leakage current of the third switch transistor T3 in the light emitting stage to the drive transistor DTFT, which would otherwise affect driving current of the drive transistor DTFT. Particularly as illustrated in FIG. 4 and FIG. 5, the third switch transistor T3 includes a third sub-switch transistor T31 and a fourth sub-switch transistor T32.

The third sub-switch transistor T31 has a drain electrically connected with a source of the fourth sub-switch transistor T32.

The third sub-switch transistor T31 has a gate, and the fourth sub-switch transistor T32 has a gate, both of which are electrically connected with the second scan signal terminal Scan2.

The third sub-switch transistor T31 has a source electrically connected with the first node N1, and the fourth sub-switch transistor T32 has a drain electrically connected with the third node N3.

In a particular implementation, all the drive transistor DTFT and the respective switch transistors as referred to in the pixel circuit above according to the embodiment of the disclosure may be designed as N-type transistors, or as illustrated in FIG. 3 to FIG. 5, all the drive transistor DTFT and the respective switch transistors may be designed as P-type transistors, thus simplifying a process flow of fabricating the pixel circuit.

In a particular implementation, in the pixel circuit above according to the embodiment of the disclosure, an N-type transistor is turned on at a high potential, and turned off at a low potential; and a P-type transistor is turned on at a low potential, and turned off at a high potential.

It shall be noted that in the pixel circuit according to the embodiment of the disclosure, the drive transistor DTFT and the respective switch transistors may be Thin Film Transistors (TFT) or Metal Oxide Semiconductor (MOS) field-effect transistors, although the embodiment of the disclosure will not be limited thereto. In a particular implementation, the sources and the drains of these transistors may be replaced with each other instead of being distinguished from each other. In one embodiment, all drive transistors and respective switch transistors described in this disclosure are thin film transistors.

An operating process of the pixel circuit above according to the embodiment of the disclosure will be described below with reference to a circuit time sequence diagram taking the structures of the pixel circuit illustrated in FIG. 3 and FIG. 5 respectively. In the following description, 1 represents a high potential, and 0 represents a low potential. It shall be noted that 1 and 0 represent logic potentials, and are only intended to better set forth a particular operating process according to an embodiment of the disclosure, but not to suggest voltage applied to the gates of the respective switch transistors in a particular implementation.

The structure of the pixel circuit illustrated in FIG. 3 will be described by the input-output time sequence diagram as illustrated in FIG. 2. Particularly there are three selected stages including an initialization stage P1, a data writing stage P2, and a light emitting stage P3 in the input-output time sequence diagram as illustrated in FIG. 2.

In the initialization stage P1, EMIT=1, Scan1=0, and Scan2=1.

With Scan1=0, the first switch transistor T1 is turned on to provide the first node N1 with the first reference signal of the first reference signal terminal VREF1, so the potential of the first node N1 is VREF1; and the seventh transistor T7 is turned on to provide the second node N2 with the second reference signal of the second reference signal terminal VREF2, so the potential of the second node N2 is VREF2, so that the first node N1 and the second node N2 are initialized and reset, and the drive transistor DTFT is turned on. With Scan2=1, the second switch transistor T2, the third switch transistor T3, and the fourth switch transistor T4 are turned off. With EMIT=1, the fifth switch transistor T5 and the sixth switch transistor T6 are turned off, so the organic light emitting diode OLED emits no light.

In the data writing stage P2, EMIT=1, Scan1=1, and Scan2=0.

With Scan1=1, the first switch transistor T1 and the seventh transistor T7 are turned off. With Scan2=0, the second switch transistor T2 is turned on to provide the source of the drive transistor DTFT with the data signal of the data signal line Data, so the potential of the second node N2 is changed to Vdata; the third switch transistor T3 is turned on to connect the gate of the drive transistor DTFT with the drain thereof, so the potentials of the first node N1 and the third node N3 are changed to Vdata−|Vth|, and at this time, Vsg of the drive transistor DTFT is changed from VREF2−VREF1 to Vdata−VREF1 then to |Vth|, so the same threshold voltage can be grabbed no matter whether a high grayscale jumps to a middle grayscale, or a low grayscale jumps to a middle grayscale; and the fourth switch transistor T4 is turned on to provide the fourth node N4 with the first reference signal of the first reference signal terminal VREF1 to thereby reset the organic light emitting diode. With EMIT=1, the fifth switch transistor T5 and the sixth switch transistor T6 are turned off, so the organic light emitting diode OLED emits no light.

In the light emitting stage P3, EMIT=0, Scan1=1, and Scan2=1.

With Scan1=1, the first switch transistor T1 and the seventh transistor T7 are turned off. With Scan2=1, the second switch transistor T2, the third switch transistor T3, and the fourth switch transistor T4 are turned off. With EMIT=0, the fifth switch transistor T5 is turned on to provide the source of the drive transistor DTFT with the high potential of the first voltage signal terminal PVDD, so the potential of the second node N2 is changed to PVDD, and at this time, Vsg of the drive transistor DTFT is $Vsg=PVDD-Vdata+|Vth|$, and $I=K(Vsg-|Vth|)^2=K(PVDD-Vdata)^2$; and the sixth switch transistor T6 is turned on to drive the organic light emitting diode OLED using the driving current of the drive transistor DTFT into operation to emit light.

The structure of the pixel circuit illustrated in FIG. 5 will be described by corresponding input-output time sequence diagram as illustrated in FIG. 2. Particularly there are three selected stages including an initialization stage P1, a data writing stage P2, and a light emitting stage P3 in the input-output time sequence diagram as illustrated in FIG. 2.

In the initialization stage P1, EMIT=1, Scan1=0, and Scan2=1.

With Scan1=0, the first switch transistor T1 is turned on to provide the first node N1 and the second node N2 with the first reference signal of the first reference signal terminal VREF1, so the potentials of the first node N1 and the second node N2 are VREF1, so that the first node N1 and the second node N2 are initialized and reset, and the drive transistor DTFT is turned on. With Scan2=1, the second switch transistor T2, the third switch transistor T3, and the fourth switch transistor T4 are turned off. With EMIT=1, the fifth switch transistor T5 and the sixth switch transistor T6 are turned off, so the organic light emitting diode OLED emits no light.

In the data writing stage P2, EMIT=1, Scan1=1, and Scan2=0.

With Scan1=1, the first switch transistor T1 is turned off. With Scan2=0, the second switch transistor T2 is turned on to provide the source of the drive transistor DTFT with the data signal of the data signal line Data, so the potential of the second node N2 is changed to Vdata; the third switch transistor T3 is turned on to connect the gate of the drive transistor DTFT with the drain thereof, so the potentials of the first node N1 and the third node N3 are changed to Vdata−|Vth|, and at this time, Vsg of the drive transistor DTFT is changed from 0 to Vdata−VREF1 to |Vth|, so the same threshold voltage can be grabbed no matter whether a high grayscale jumps to a middle grayscale, or a low grayscale jumps to a middle grayscale; and the fourth switch transistor T4 is turned on to provide the fourth node N4 with the first reference signal of the first reference signal terminal VREF1 to thereby reset the organic light emitting diode. With EMIT=1, the fifth switch transistor T5 and the sixth switch transistor T6 are turned off, so the organic light emitting diode OLED emits no light.

In the light emitting stage P3, EMIT=0, Scan1=1, and Scan2=1.

With Scan1=1, the first switch transistor T1 is turned off. With Scan2=1, the second switch transistor T2, the third switch transistor T3, and the fourth switch transistor T4 are turned off. With EMIT=0, the fifth switch transistor T5 is turned on to provide the source of the drive transistor DTFT with the high potential of the first voltage signal terminal PVDD, so the potential of the second node N2 is changed to PVDD, and at this time, Vsg of the drive transistor DTFT is $Vsg=PVDD-Vdata+|Vth|$, and $I=K(Vsg-|Vth|)^2=K(PVDD-Vdata)^2$; and the sixth switch transistor T6 is turned on to drive the organic light emitting diode OLED using the driving current of the drive transistor DTFT into operation to emit light.

Based upon the same inventive idea, an embodiment of the disclosure further provides a method for driving a pixel circuit as illustrated in FIG. 2, where the method includes following operations.

An initialization stage P1 provides the first scan signal terminal Scan1 with a first level signal, the second scan signal terminal Scan2 with a second level signal, and the light emitting control terminal EMIT with the second level signal.

A data writing stage P2 provides the first scan signal terminal Scan1 with the second level signal, the second scan signal terminal Scan2 with the first level signal, and the light emitting control terminal EMIT with the second level signal.

A light emitting stage P3 provides the first scan signal terminal Scan1 with the second level signal, the second scan signal terminal Scan2 with the second level signal, and the light emitting control terminal EMIT with the first level signal.

Optionally in the method for driving the pixel circuit above according to the embodiment of the disclosure, the first level signal may be a high potential signal, and correspondingly the second level signal may be a low potential signal. In another embodiment, as illustrated in FIG. 2, the first level signal may be a low potential signal, and correspondingly the second level signal may be a high potential signal, dependent upon whether a switch transistor is an N-type transistor or a P-type transistor.

Figure 7:
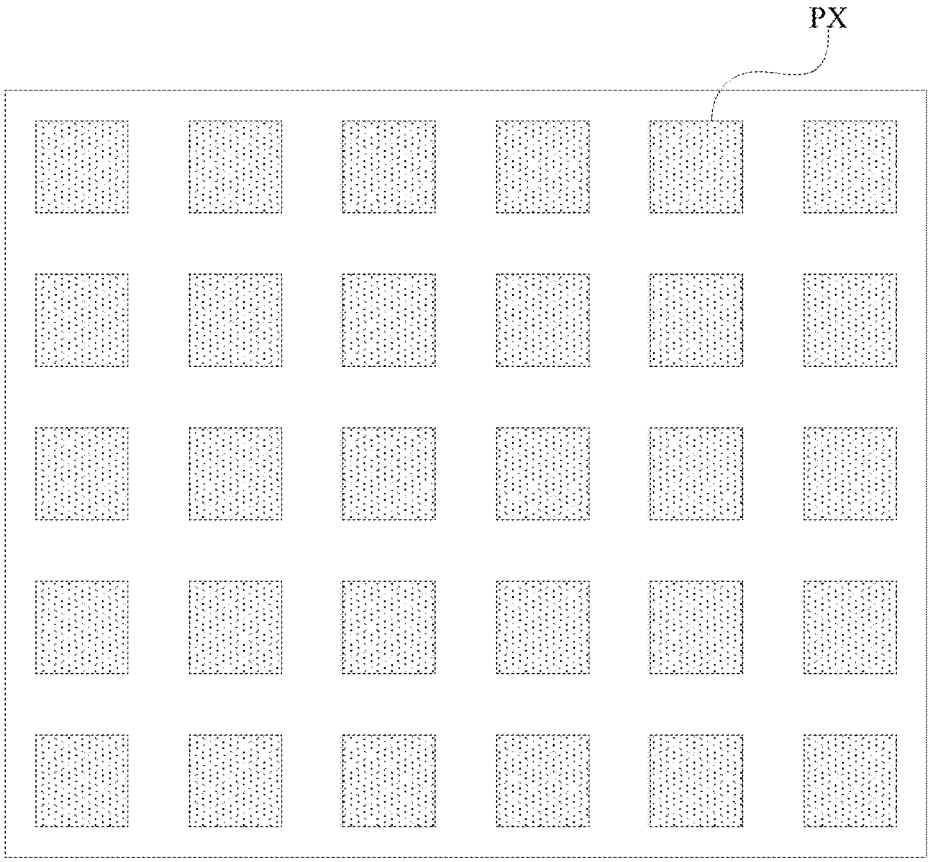
FIG. 7 is a schematic structural diagram of an organic electroluminescent display panel according to an embodiment of the disclosure.
Figure 8:
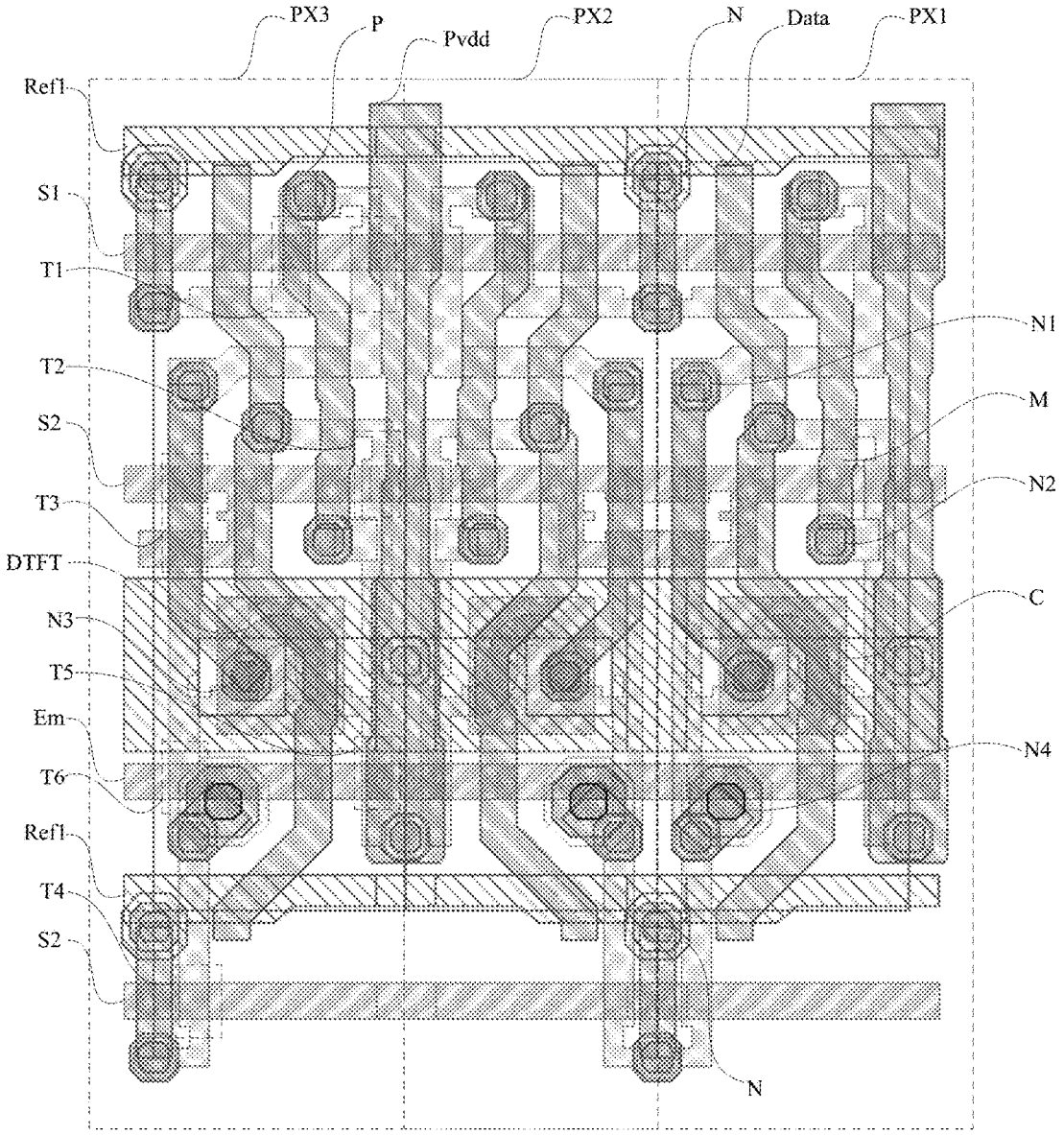
FIG. 8 is a schematic structural diagram of three pixel circuits in the organic electroluminescent display panel according to the embodiment of the disclosure.

Based upon the same inventive idea, an embodiment of the disclosure further provides an organic electroluminescent display panel as illustrated in FIG. 7 including a plurality of arrayed pixel circuits according to any embodiments above of the disclosure, and since the organic electroluminescent display panel addresses the problem under a similar principle to that of the pixel circuit above. Reference can be made to the implementations of the pixel circuit above for an implementation of the organic electroluminescent display panel, and a repeated description thereof will be omitted here. FIG. 8 illustrates three pixel circuits PX1, PX2, and PX3 in the circuit structure illustrated in FIG. 5.

In a particular implementation, in the organic electroluminescent display panel above according to the embodiment of the disclosure, in order to save a circuit wiring space so as to make the circuit design more compact, as illustrated in FIG. 8, two adjacent pixel circuits PX1 and PX2, and PX2 and PX3 in each row can be arranged in a mirror pattern, that is, arranged symmetric in the left-and-right direction.

In a particular implementation, in the organic electroluminescent display panel above according to the embodiment of the disclosure, as illustrated in FIG. 8, the organic electroluminescent display panel can further includes a plurality of first scan signal lines S1, a plurality of second scan lines S2, a plurality of first reference signal lines Ref1, a plurality of light emitting control lines Em, a plurality of data signal lines Data, and a plurality of first voltage signal lines Pvdd, where generally the plurality of first scan signal lines S1, the plurality of second scan lines S2, the plurality of first reference signal lines Ref1, and the plurality of light emitting control lines Em are substantially parallel to each other, and can be arranged at the same metal film layer; and the plurality of data signal lines Data, the plurality of first voltage signal lines Pvdd, and the connection lines M as illustrated in FIG. 6 are substantially parallel to each other, and can be arranged at the same metal film layer.

In a particular implementation, in the organic electroluminescent display panel above according to the embodiment of the disclosure, as illustrated in FIG. 8, the sources, the drains, and channel areas of the respective transistors may be arranged in a semiconductor layer. A corresponding doping process may be performed at the sources and the drains, the semiconductor layer is typically made of low temperature poly-silicon, and the semiconductor layer is typically located below the first metal layer as needed for a process thereof.

In a particular implementation, in the organic electroluminescent display panel above according to the embodiment of the disclosure, as illustrated in FIG. 8, in order to save a circuit wiring space so as to make the circuit design more compact, at least two adjacent pixel circuits PX1 and PX2 can be connected with the first reference signal lines Ref1 through the same connection hole N.

In a particular implementation, in the organic electroluminescent display panel above according to the embodiment of the disclosure, as illustrated in FIG. 8, in order to save a circuit wiring space so as to make the circuit design more compact, at least two adjacent columns of pixel circuits PX1 and PX2 can be connected to the same one of the first voltage signal lines Pvdd.

In the pixel circuit, the method for driving the same, and the organic electroluminescent display panel above according to the embodiments of the disclosure, both the first node and the second node can be reset in the initialization stage through the first switch transistor and the seventh switch transistor in the node initialization module to thereby avoid their difference in potential due to the parasitic capacitance between them. The drive transistor has the gate electrically connected with the first node, and the source electrically connected with the second node; and since the drive transistor is reset in the initialization stage avoid the problem of a differently grabbed threshold due to a voltage jump, the same brightness of the first frame can be guaranteed after the image is switched between high and low grayscales. Furthermore the drive transistor is completely reset in the initialization stage of each frame so that an afterimage can also be avoided from occurring as a result of an offset of the threshold voltage of the drive transistor.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A pixel circuit comprising:

a node initialization module;

a data writing module;

an anode reset module;

a light emitting control module;

a drive control module; and an organic light emitting diode;

wherein the node initialization module comprises: a first switch transistor with a gate electrically connected with a first scan signal terminal, a source electrically connected with a first reference signal terminal, and a drain electrically connected with a first node;

wherein the data writing module comprises a second switch transistor and a third switch transistor, wherein the second switch transistor has a gate electrically connected with a second scan signal terminal, a source electrically connected with a data signal terminal, and a drain electrically connected with a second node; and the third switch transistor has a gate electrically connected with the second scan signal terminal, a source electrically connected with a third node, and a drain electrically connected with the first node;

wherein the anode reset module comprises: a fourth switch transistor with a gate electrically connected with the second scan signal terminal, a source electrically connected with the first reference signal terminal, and a drain electrically connected with a fourth node;

wherein the light emitting control module comprises a fifth switch transistor and a sixth switch transistor, wherein the fifth switch transistor has a gate electrically connected with a light emitting control terminal, a source electrically connected with a first voltage signal terminal, and a drain electrically connected with the second node; and wherein the sixth switch transistor has a gate electrically connected with the light emitting control terminal, a source electrically connected with the third node, and a drain electrically connected with the fourth node;

wherein the drive control module comprises a drive transistor and a capacitor, wherein the drive transistor has a gate electrically connected with the first node, a source electrically connected with the second node, and a drain electrically connected with the third node; and the capacitor is connected between the first node and the first voltage signal terminal;

wherein the organic light emitting diode is connected between the fourth node and a second voltage signal terminal;

wherein the node initialization module further comprises a seventh switch transistor; and wherein the seventh switch transistor has a gate electrically connected with the first scan signal terminal, a source electrically connected with a second reference signal terminal, and a drain electrically connected with the second node.

2. The pixel circuit according to claim 1, wherein the second reference signal terminal and the first reference signal terminal are provided with signals by a same signal terminal.

3. The pixel circuit according to claim 1, wherein the second reference signal terminal and the first voltage signal terminal are provided with signals by a same signal terminal.

4. The pixel circuit according to claim 1, wherein the first switch transistor has a dual gate structure, and comprises a first sub-switch transistor and a second sub-switch transistor, wherein:

the first sub-switch transistor has a drain electrically connected with a source of the second sub-switch transistor;

the first sub-switch transistor has a gate, and the second sub-switch transistor has a gate, both of which are electrically connected with the first scan signal terminal; and the first sub-switch transistor has a source electrically connected with the first reference signal terminal, and the second sub-switch transistor has a drain electrically connected with the first node.

5. The pixel circuit according to claim 1, wherein the third switch transistor has a dual gate structure, and comprises a third sub-switch transistor and a fourth sub-switch transistor, wherein:

the third sub-switch transistor has a source electrically connected with a drain of the fourth sub-switch transistor;

the third sub-switch transistor has a gate, and the fourth sub-switch transistor has a gate, both of which are electrically connected with the second scan signal terminal; and the third sub-switch transistor has a drain electrically connected with the first node, and the fourth sub-switch transistor has a source electrically connected with the third node.

6. The pixel circuit according to claim 1, wherein all switch and sub-switch transistors in the pixel circuit are P-type transistors.

7. A method for driving the pixel circuit according to claim 1, the method comprising:

an initialization stage to provide the first scan signal terminal with a first level signal, the second scan signal terminal with a second level signal, and the light emitting control terminal with the second level signal;

a data writing stage to provide the first scan signal terminal with the second level signal, the second scan signal terminal with the first level signal, and the light emitting control terminal with the second level signal; and a light emitting stage to provide the first scan signal terminal with the second level signal, the second scan signal terminal with the second level signal, and the light emitting control terminal with the first level signal.

8. An organic electroluminescent display panel, comprising a plurality of arrayed pixel circuits, each comprising a node initialization module, a data writing module, an anode reset module, a light emitting control module, a drive control module, and an organic light emitting diode:

wherein the node initialization module comprises a first switch transistor with a gate electrically connected with a first scan signal terminal, a source electrically connected with a first reference signal terminal, and a drain electrically connected with a first node;

wherein the data writing module comprises a second switch transistor and a third switch transistor, wherein the second switch transistor has a gate electrically connected with a second scan signal terminal, a source electrically connected with a data signal terminal, and a drain electrically connected with a second node; and the third switch transistor has a gate electrically connected with the second scan signal terminal, a source electrically connected with a third node, and a drain electrically connected with the first node;

wherein the anode reset module comprises a fourth switch transistor with a gate electrically connected with the second scan signal terminal, a source electrically connected with the first reference signal terminal, and a drain electrically connected with a fourth node;

wherein the light emitting control module comprises a fifth switch transistor and a sixth switch transistor, wherein the fifth switch transistor has a gate electrically connected with a light emitting control terminal, a source electrically connected with a first voltage signal terminal, and a drain electrically connected with the second node; and the sixth switch transistor has a gate electrically connected with the light emitting control terminal, a source electrically connected with the third node, and a drain electrically connected with the fourth node;

wherein the drive control module comprises a drive transistor and a capacitor, wherein the drive transistor has a gate electrically connected with the first node, a source electrically connected with the second node, and a drain electrically connected with the third node; and the capacitor is connected between the first node and the first voltage signal terminal;

wherein the organic light emitting diode is connected between the fourth node and a second voltage signal terminal; and wherein the node initialization module further comprises a seventh switch transistor; and wherein the seventh switch transistor has a gate electrically connected with the first scan signal terminal, a source electrically connected with a second reference signal terminal, and a drain electrically connected with the second node.

9. The organic electroluminescent display panel according to claim 8, wherein the first switch transistor has a dual gate structure, and comprises a first sub-switch transistor and a second sub-switch transistor, wherein:

the first sub-switch transistor has a drain electrically connected with a source of the second sub-switch transistor;

the first sub-switch transistor has a gate, and the second sub-switch transistor has a gate, both of which are electrically connected with the first scan signal terminal; and the first sub-switch transistor has a source electrically connected with the first reference signal terminal, and the second sub-switch transistor has a drain electrically connected with the first node.

10. The organic electroluminescent display panel according to claim 8, wherein two adjacent pixel circuits in each row are arranged in a mirror pattern.

11. The organic electroluminescent display panel according to claim 10, wherein the organic electroluminescent display panel further comprises a plurality of first scan signal lines, a plurality of second scan lines, a plurality of first reference signal lines, a plurality of light emitting control lines, a plurality of data signal lines, and a plurality of first voltage signal lines, wherein:

at least two adjacent pixel circuits are connected with the first reference signal lines through a same connection hole.

12. The organic electroluminescent display panel according to claim 11, wherein at least two adjacent columns of pixel circuits are connected with a same one of the first voltage signal lines.

13. A pixel circuit comprising:

a node initialization module;

a data writing module;

an anode reset module;

a light emitting control module;

a drive control module; and an organic light emitting diode;

wherein the node initialization module comprises a first switch transistor with a gate electrically connected with a first scan signal terminal, a source electrically connected with a reference signal terminal, and a drain electrically connected with a first node; wherein the reference signal terminal comprises a first reference signal terminal or a second reference signal terminal;

wherein the data writing module comprises a second switch transistor and a third switch transistor, wherein the second switch transistor has a gate electrically connected with a second scan signal terminal, a source electrically connected with a data signal terminal, and a drain electrically connected with a second node; and wherein the third switch transistor has a gate electrically connected with the second scan signal terminal, a source electrically connected with a third node, and a drain electrically connected with the first node;

wherein the anode reset module comprises a fourth switch transistor with a gate electrically connected with the second scan signal terminal, a source electrically connected with the reference signal terminal, and a drain electrically connected with a fourth node;

wherein the light emitting control module comprises a fifth switch transistor and a sixth switch transistor, wherein the fifth switch transistor has a gate electrically connected with a light emitting control terminal, a source electrically connected with a first voltage signal terminal, and a drain electrically connected with the second node; and the sixth switch transistor has a gate electrically connected with the light emitting control terminal, a source electrically connected with the third node, and a drain electrically connected with the fourth node;

wherein the drive control module comprises a drive transistor and a capacitor, wherein the drive transistor has a gate electrically connected with the first node, a source electrically connected with the second node, and a drain electrically connected with the third node; and the capacitor is connected between the first node and the first voltage signal terminal;

wherein the organic light emitting diode is connected between the fourth node and a second voltage signal terminal;

wherein the first switch transistor has a dual gate structure, and comprises a first sub-switch transistor and a second sub-switch transistor:

wherein the first sub-switch transistor has a drain electrically connected with a source of the second sub-switch transistor;

wherein the first sub-switch transistor has a gate, and the second sub-switch transistor has a gate, both of which are electrically connected with the first scan signal terminal; and wherein the first sub-switch transistor has a source electrically connected with the reference signal terminal, and the second sub-switch transistor has a drain electrically connected with the first node; and wherein a connection node between the drain of the first sub-switch transistor, and the source of the second sub-switch transistor is electrically connected with the second node.

14. The pixel circuit according to claim 13, wherein the pixel circuit further comprises a connection line between the second node and the connection node; and wherein the connection line has one terminal electrically connected with the source of the drive transistor through a via hole, and another terminal electrically connected with the connection node through a via hole.

15. An organic electroluminescent display panel according to claim 13, comprising a plurality of arrayed pixel circuits.

16. The organic electroluminescent display panel according to claim 15, wherein the plurality of arrayed pixel circuits each further comprises a connection line between the second node and the connection node; and wherein the connection line has one terminal electrically connected with the source of the drive transistor through a via hole, and another terminal electrically connected with the connection node through a via hole.

* * * * *